US007338047B2

(12) United States Patent
Kelley et al.

(10) Patent No.: US 7,338,047 B2
(45) Date of Patent: Mar. 4, 2008

(54) BALL PITCHING GAME AND METHOD

(75) Inventors: Sam Jackson Kelley, Greenville, TX (US); Christopher H. Davis, Greenville, TX (US)

(73) Assignee: OOnagi, LLC, Greenville, TX (US)

( * ) Notice: Subject to any disclaimer, the term of this patent is extended or adjusted under 35 U.S.C. 154(b) by 173 days.

(21) Appl. No.: 10/820,617

(22) Filed: Apr. 8, 2004

(65) Prior Publication Data

US 2005/0012266 A1 Jan. 20, 2005

Related U.S. Application Data

(60) Provisional application No. 60/488,157, filed on Jul. 18, 2003.

(51) Int. Cl.
*A63B 67/00* (2006.01)
*A63F 9/00* (2006.01)

(52) U.S. Cl. ..... 273/317; 473/415; 473/465; 273/118 R

(58) Field of Classification Search ..... 273/118 R, 273/108, 348, 317, 336, 338; 473/490
See application file for complete search history.

(56) References Cited

U.S. PATENT DOCUMENTS

| | | | | |
|---|---|---|---|---|
| 269,351 | A | 12/1882 | Turner | |
| 429,639 | A * | 6/1890 | Reiz | 273/108 |
| 697,574 | A * | 4/1902 | Walenta | 273/108 |
| 2,366,782 | A | 1/1945 | Gorsuch | |
| 3,231,278 | A | 1/1966 | Boulanger | |
| 3,406,973 | A | 10/1968 | Poole | |
| 3,680,864 | A * | 8/1972 | Peterson | 273/110 |
| 4,453,713 | A * | 6/1984 | Guyer | 273/118 R |
| 5,125,669 | A * | 6/1992 | Kanda | 273/348 |
| 5,199,708 | A | 4/1993 | Lucas | |
| 5,465,962 | A | 11/1995 | Hiserman | |
| 6,840,515 | B2 * | 1/2005 | Seme | 273/118 R |
| 2004/0173961 | A1 * | 9/2004 | Seme | 273/118 R |
| 2005/0012266 | A1 * | 1/2005 | Kelley et al. | 273/118 R |

OTHER PUBLICATIONS

Attached declaration of Inventors.

* cited by examiner

*Primary Examiner*—Raleigh W. Chiu
(74) *Attorney, Agent, or Firm*—Cash Klemchuk Powers Taylor LLP; Darin M. Klemchuk

(57) ABSTRACT

The present invention discloses a bowling/pitching game that can be played virtually anywhere a substantially flat surface can be found and is enjoyable for adults as well as children. The playing field includes a distance marker and a scoring goal comprised of an outer scoring area and an inner scoring area. The goal also includes a game pole called the OOnagi™ pole and an object ball called an OOnagi™ ball, which sits on top of the OOnagi™ pole. While standing at the distance marker, the players pitch or bowl their balls called chuckers at the scoring goal. Scores are calculated according to the placement of the chuckers and OOnagi™ ball in the scoring goal.

11 Claims, 3 Drawing Sheets

BALL PITCHING GAME AND METHOD

This application claims priority and the benefit under 35 U.S.C. § 119(e) from U.S. provisional patent application 60/488,157 for "Oonagi," filed Jul. 18, 2003, which is hereby incorporated by reference.

BACKGROUND OF THE INVENTION

1. Field of the Invention

The present invention relates generally to lawn games and other games playable on a variety of surfaces involving pitching or bowling game pieces toward a scoring goal to generate a score based upon the position of the game pieces and other playing pieces.

2. Description of Related Art

Prior art games of these types employ a variety of equipment, playing surfaces, and game elements.

In U.S. Pat. No. 269,351, a game of lawn pool is disclosed. Stakes are used to support various balls. Players strike game balls with a mallet to score points by knocking the game balls against the stakes and thereby knocking off the ball resting atop each stake.

U.S. Pat. No. 2,366,782 discloses a game wherein players score points by rolling balls along the playing surface to a scoring goal. The scoring goal includes an object ball placed in the goal. Points are awarded based upon the position of balls and an object ball in the scoring goal. The players use a roller or other device to roll the game balls.

In U.S. Pat. No. 3,231,278, a game with two goals, each goal containing a goal ball and support, is disclosed. Players stand behind the goals and pitch or bowl their game balls to the opposite goal. Points are awarded based upon the closeness of the game ball to the support and whether the goal ball is knocked off the support.

U.S. Pat. No. 3,406,973 discloses a lawn bowling game with a target ring. The target ring has four quadrants of different colors. Players attempt to land four game balls of the same differing colors into the target ring. Points are scored for any ball rolling within the periphery of the ring. Additional points are awarded for balls that roll into quadrants of the ring with a color that matches that of the ball.

In U.S. Pat. No. 5,199,708, a lawn rolling game is disclosed. The game consists of ring playing elements and a pair of spaced playing posts positioned at opposing ends of a generally flat playing surface. Players roll the playing rings toward a pair of posts. Points are awarded based on the closeness of the rings to the playing posts.

U.S. Pat. No. 5,456,962 discloses a ball rolling game, which is comprised of two goals, each having a stake at the center and a scoring zone in the form of a circle around the stake at a predetermined distance. Players roll balls toward the goals and are awarded points based on the closeness of the balls to the stakes.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The present invention discloses a bowling/pitching game that can be played virtually anywhere a substantially flat surface can be found and is enjoyable for adults as well as children. The playing field includes a distance marker and a scoring goal comprised of an outer scoring area and an inner scoring area. The goal also includes a game pole called the OOnagi™ pole and an object ball called an OOnagi™ ball, which sits on top of the OOnagi™ pole. While standing at the distance marker, the players pitch or bowl their balls called chuckers at the scoring goal. Scores are calculated according to the placement of the chuckers and OOnagi™ ball in the scoring goal.

Other objects, features, and advantages of the present invention will become apparent with reference to the drawings and detailed description that follow.

DETAILED DESCRIPTION OF THE PREFERRED EMBODIMENT

In the following detailed description of the preferred embodiments, reference is made to the accompanying drawings, which form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Number of Players

The game may be played by two to eight players, either individually or in teams. Up to eight individuals may play as single players, or the players can play in teams of two to four players each.

The Court and Equipment

Figure 1:
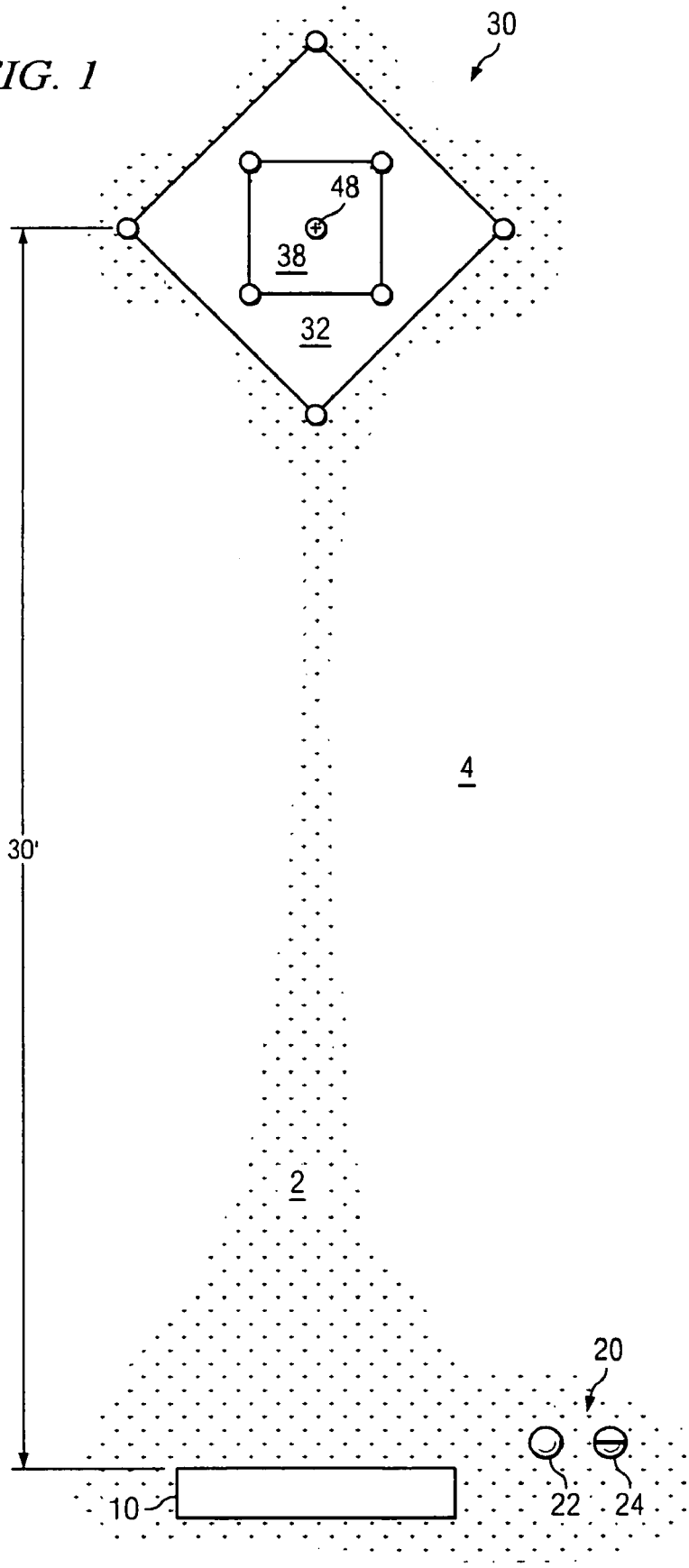
FIG. 1 is a top view of the present invention illustrating the playing field 2 of the game, playing surface 4, chucker board 10, scoring goal 30, a solid chucker 22, and a striped chucker 24.

While not a requirement, the OOnagi™ game is preferably played on a substantially flat playing surface 4. A lawn or other soft surface is optimal although the game may be played on a variety of surfaces, including sand, clay, and the like. The game equipment includes a distance marker 10 called the chucker board, balls 20 called chuckers, and a scoring goal 30. As shown in FIG. 1, the chucker board 10 is optimally placed thirty feet from the center of the scoring goal 30. This distance, however, is not a requirement and may be adjusted to accommodate the physical characteristics of the participants and the playing conditions.

Figure 2:
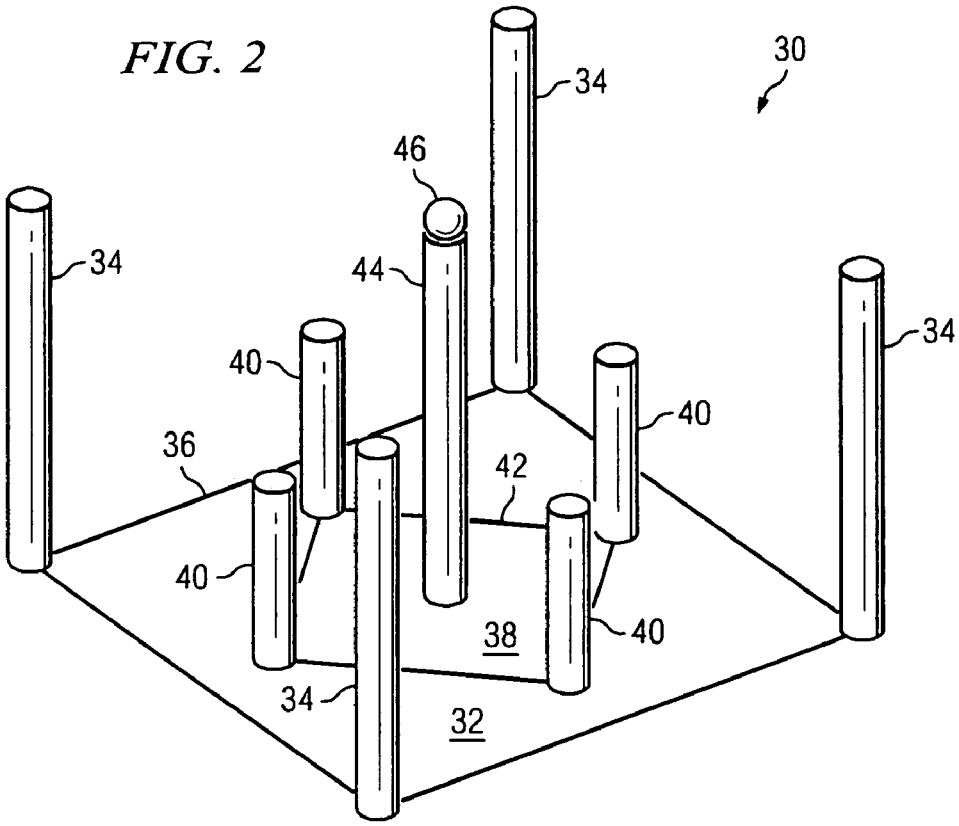
FIG. 2 is a perspective view of the scoring goal 30 of the present invention illustrating the outer diamond 32, inner square 38, OOnagi™ pole 44, and OOnagi™ ball 46.

Turning to FIG. 2, in the preferred embodiment, the scoring goal 30 is comprised of an outer square 32 called the outer diamond, an inner square 38, a center pole 44 called the OOnagi™ pole, and a ball 46 called the OOnagi™ ball. The outer diamond 32 is formed by four outer poles 34; the inner square 38 is formed by four inner poles 40. The outer poles 34 of the outer diamond 32 are optimally configured to form a square with 41-inch sides. The inner poles 40 of the inner square 38 are optimally configured to form a square with 20.5-inch sides. The outer poles 34 and the inner poles 40 are inserted into the playing surface 4 such that they are substantially perpendicular to the playing surface 4. Preferably, the outer poles 34 and the inner poles 40 are inserted approximately eight inches in the ground. However, exactly eight inches is not required so long as the outer poles 34 and the inner poles 40 are sufficiently secured to withstand the impact of the chuckers 20.

In the preferred embodiment, a line comprised of a cord, string, wire, fishing line, or other suitable material is attached to each outer pole 34 to form an outer boundary 36 of the outer diamond 32. One skilled in the art would appreciate the multitude of different materials and manners in which this objective can be achieved. Likewise, a line is also attached to each inner pole 40 to former an inner square boundary 42. Preferably, the lines of the outer boundary and the inner boundary are placed close to the playing surface. Use of the lines, however, is not a requirement. The game can be successfully played without lines attached to the inner poles 40 and outer poles 34. In that case, the players gauge whether a chucker 20 or OOnagi™ ball 46 is within the outer diamond 32 or inner square 38 by visually inspecting the boundaries created by the perimeter of the outer diamond 32 or inner square 38 formed by the outer poles 34 and the inner poles 40. In the preferred embodiment, as shown in FIG. 2, the outer diamond 32 is rotated approximately 45 degrees relative to the inner square 38. Both the outer diamond 32 and the inner square 38 share a common center point.

Figure 3:
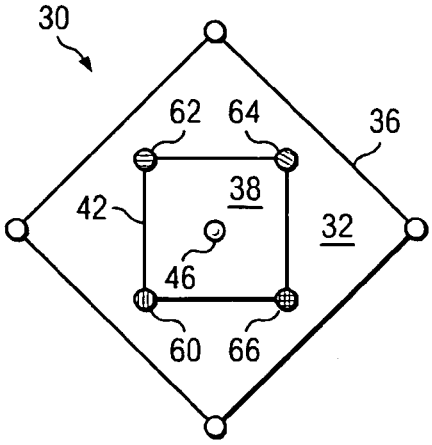
FIG. 3 is a top view of the scoring goal 30 of the present invention illustrating the outer diamond 32, inner square 38, and OOnagi™ ball 46.

In the preferred embodiment, the four inner square poles 40 are colored differently to match the colors of the chuckers 20. Preferably, the poles 40 are red, blue, green, and yellow. Referring to FIG. 3, the red inner square pole 60 is positioned at the left-hand corner of the inner square 38 closest to the chucker board 10. In a clockwise fashion, the blue inner square pole 62 occupies the next corner, followed by the green inner square pole 64 and yellow inner square pole 66. The order by which players or teams pitch their chuckers 20 is governed by the order of inner square poles 40. The team using red chuckers 20 pitches first, followed by the team using the blue chuckers 20, then the team using the green chuckers 20, and finally the team pitching the yellow chuckers 20. To suit the players' desires, this order may be varied and different colors may be used.

As shown in FIG. 2, the game pole referred to as the OOnagi™ pole 44 is placed at the center of the outer diamond 32 and inner square 38. The OOnagi™ pole 44 is inserted into the playing surface 4 such that it is substantially perpendicular to the surface. Before the participants begin play, the OOnagi™ ball 46 is placed on top of the OOnagi™ pole 44. FIG. 2 illustrates the preferred lateral dimensions between the OOnagi™ pole 44 and the outer diamond pole 34, the inner square pole 40, and the center of the side of the outer diamond 32. Preferably, the distance between the OOnagi™ pole 44 and the outer diamond pole 34 is 29 inches; the distance between the OOnagi™ pole 44 and the inner square pole 40 is 14.5 inches; and the distance between the OOnagi™ pole 44 and the center of one of the sides of the outer diamond 32 is 20.5 inches. The invention does not require that these distances be exact, and they may be varied and still achieve the same desired results. For example, if the dimensions of the scoring goal 30 are modified to accommodate the physical characteristics of the participants or the playing conditions, the aforementioned dimensions will likewise be modified.

In an alternative embodiment, the outer diamond 32 and inner square 38 are replaced with an outer scoring area 70 and inner scoring area 72. The outer scoring area 70 and inner scoring area 72 can be created by marking the playing surface in a manner such that the perimeter of the scoring areas are visually distinguishable from the playing surface 4. One skilled in the art would recognize that this could be accomplished by paint, spray paint, chalk, sand, and other suitable materials. The outer scoring area 70 and inner scoring area 72 can also be marked by the use of rope, string, chain, and the like placed on the playing surface 4. The outer scoring area 70 and inner scoring area 72 are not required to be square in shape and may be of any shape. Moreover, the OOnagi™ pole 44 is not required to be placed at the center of the outer scoring area 70 and inner scoring area 72. The OOnagi™ pole 44 may be optionally placed anywhere inside the area of the outer scoring area 70. Typically, the inner scoring area 72 has an area and a perimeter less than the area and perimeter of the outer scoring area 70. Although not required, the perimeter of the inner scoring area 72 is typically located inside the perimeter of outer scoring area 70.

Four pairs of colored balls called chuckers 20 are preferably used. The chuckers 20 may be constructed of wood, plastic, or any other suitable material. Typically, the chuckers 22 are colored red, blue, green, and yellow. One set of chuckers 22 is typically solid; the other set of chuckers 24 is typically white with a stripe of one of the above colors or solid colored with a black stripe. Any type of chuckers 20 may be used so long as they are visually distinguishable. If each team has two players, the teams will use the same color chuckers 20. One team will use one color; the other teams will use chuckers 20 of one of the other colors. If each team has three or four players, one team will use the striped chuckers 24 and the other team will use the solid chuckers 22.

Figure 4:
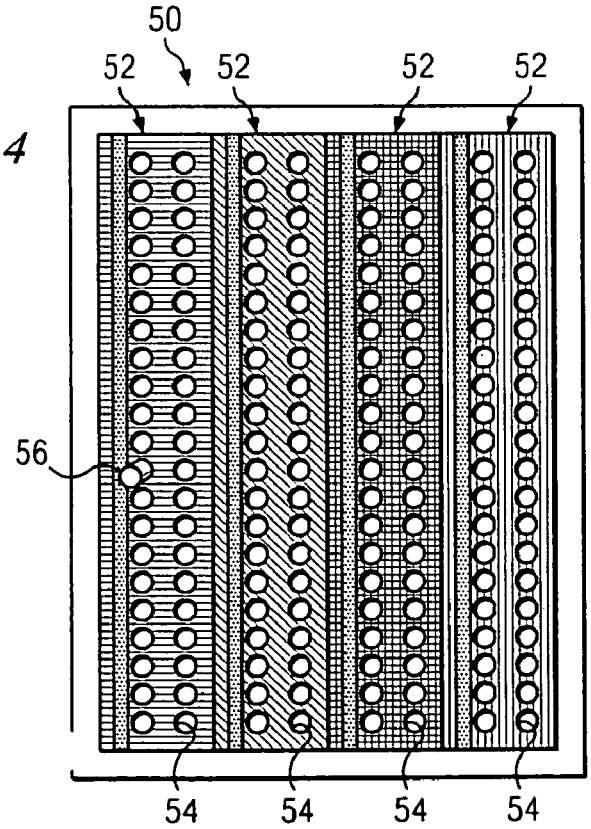
FIG. 4 is a top view of the OOnagi™ scoreboard 50 of the present invention illustrating the OOnagi™ scoreboard 50, scoring strip 52, slot 54, and scoring pin 56.

To keep score, the players may use an optional OOnagi™ scoreboard 50. As shown in FIG. 4, the scoreboard is comprised of four strips 52 colored red, blue, green, and yellow, matching the colors of the chuckers 20. Each strip 52, has two rows of twenty-one slots 54 each. The score is kept by inserting a pin 56 in the slot 54 corresponding to the score. For example, if the red team's score is ten points, the pin 56 is inserted in the tenth slot 54 from the bottom of the red strip 52. One skilled in the art would appreciate the numerous different methods that may be employed to keep score, such as using the scoreboard 50 or paper and pencil.

Purpose of the Game

The purpose of the game is to score points by pitching the chucker 20 onto the scoring goal 30. Typically, the first player or team to score exactly twenty-one points wins. This score, however, may be varied according to the players' desires.

Rules

The following rules apply to the preferred embodiment. The players may omit some of the following rules without departing from the nature and the spirit of the invention. Modifications to the rules may be preferable due to playing conditions or the physical limitations of the players.

A legal pitch in the game of OOnagi™ may be bowled (rolled on the ground) or tossed at the OOnagi™ pole 44 in any fashion a player desires. However, at the initiation of the pitch, the player must have one foot on the chucker board 10. It is permissible to stand in front of the board 10, as long as one foot is on the board 10 when the pitch is started.

In the preferred embodiment, the first player/team to get exactly twenty-one points wins. Other point limits, however, may be used. Points are awarded only after every player has pitched their chucker 20. Points are counted according to proximity to the OOnagi™ pole 44. If two players are at 20 points and each scores exactly one point on their pitch, then the player that is closest to the OOnagi™ pole 44 received the point first and is the winner. If a player scores more than twenty-one points, that player must subtract the points the player has just scored. For example, if a player/team has 20 points and scores three points, the player/team must subtract the three points from their score. The player/team now has seventeen points and continues to play.

Stealing points is allowed. Because points are scored only after every player has pitched, any points scored by a player that has gone before a subsequent player can be stolen by striking the preceding player's chucker 20 out of scoring position. This rule also applies when the OOnagi™ ball 46 has been knocked off the OOnagi™ pole 44.

The order of throw is governed by points. The player with the lowest number of points throws first. If more than one player has the same score, the player that has most recently attained that score will throw first. If more than one player has the same score and arrived at that score on the same throw, the order of colors is used to determine who pitches firsts, (red followed in order by blue, green, and yellow). This order matches the order of the colored inner square poles 40. Starting with the red inner square pole 60 and looking clockwise, the blue inner square pole 62 is next, followed by the green inner square pole 64 and yellow inner square pole 66. This order of throw is critical as it allows players with fewer points the opportunity to place their chuckers 20 in defense around the OOnagi™ pole 44 before the players with a higher score get to pitch.

To start the game, each player will chuck once and the highest scoring chucker 20 gets to start the game. If no one scores, the player whose chucker 20 is closest to the OOnagi™ pole 44 starts the game. This is called the proximity rule. Other players fill in the order by the next highest score or the next closest chucker. After the first round, points dictate the throwing order, if points are not scored, then the proximity rule still applies.

Scoring

Figure 5:
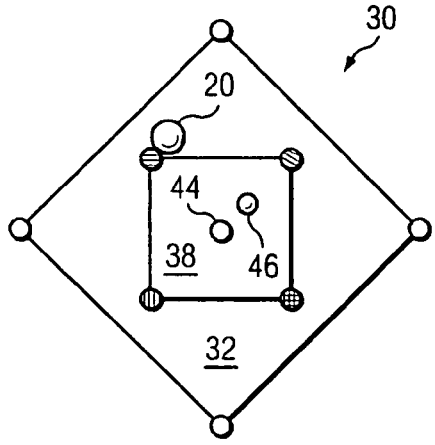
FIG. 5 is a top view of the scoring goal 30 of the present invention illustrating potential positions of the chucker 20 and the OOnagi™ ball 46 during game play.

A player/team gets one point when the chucker 20 lands in the outer diamond 32. A player/team gets three points when the chucker 20 lands in the inner square 38. Any time the OOnagi™ ball 46 is knocked off the OOnagi™ pole 44, it is called an "OOnagi." A player/team scores points on an OOnagi™ only when the OOnagi™ ball 46 and their chucker 20 stays within the outer diamond 32 or inner square 38. A player/team gets five points for the OOnagi™ when three criteria are met: the chucker 20 knocks the OOnagi™ ball 46 off the OOnagi™ pole 44, the OOnagi™ ball 46 lands in the inner square 38 and the chucker 20 stays within the outer diamond 32 or inner square 38. In this case, both the OOnagi™ and the chucker are scored. Referring to FIG. 5, the player/team gets six points, five points for the OOnagi™ ball 46 staying in the inner square 38 and one point for the chucker 20 staying in the outer diamond 32.

Figure 6:
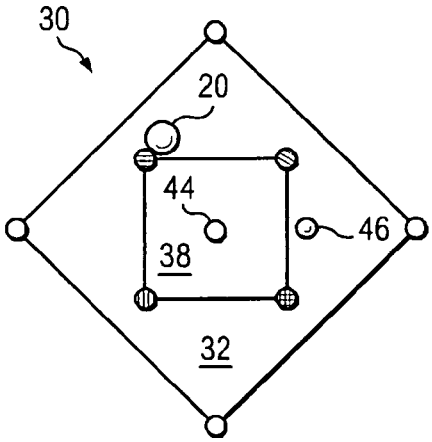
FIG. 6 is another top view of the scoring goal 30 of the present invention illustrating potential positions of the chucker 20 and the OOnagi™ ball 46 during game play.
Figure 7:
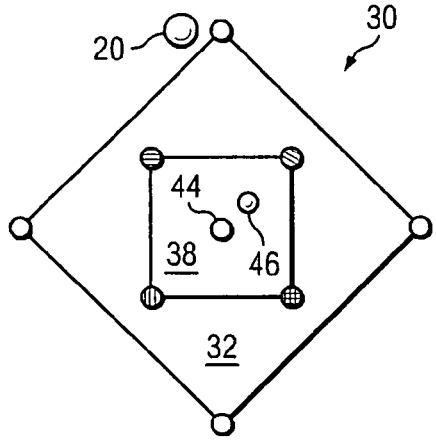
FIG. 7 is another top view of the scoring goal 30 of the present invention illustrating potential positions of the chucker 20 and the OOnagi™ ball 46 during game play.

A player/team gets three points for the OOnagi™ when the OOnagi™ ball 46 lands in the outer diamond 32 and the chucker 20 stays within the outer diamond 32 or inner square 38. Both the OOnagi™ and the chucker 20 are scored. Referring to FIG. 6, the player/team gets four points, three for the OOnagi™ and one for the chucker 20 landing in the outer diamond 32. A player/team's chucker 20 must remain within the outer diamond 32 or inner square 38 to score any points from an OOnagi™. Referring to FIG. 7, the player/team does not score because the chucker 20 rolled outside the outer diamond 32 after the OOnagi™ ball 46 was knocked off the OOnagi™ pole 44.

Figure 8:
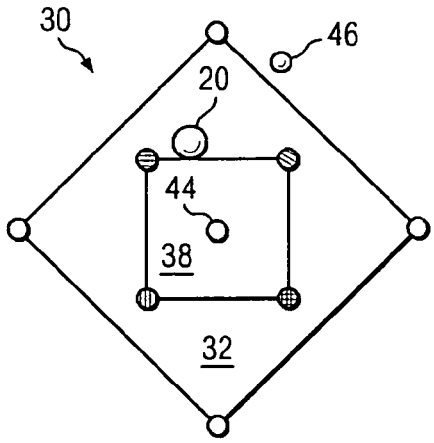
FIG. 8 is another top view of the scoring goal 30 of the present invention illustrating potential positions of the chucker 20 and the OOnagi™ ball 46 during game play.

Referring to FIG. 8, if a player/team knocks the OOnagi™ ball 46 off the OOnagi™ pole 44 and the OOnagi™ ball 46 lands outside the outer diamond 32, that player/team's score rolls back to equal that of the lowest scoring team/player after the conclusion of the turn.

Figure 9:
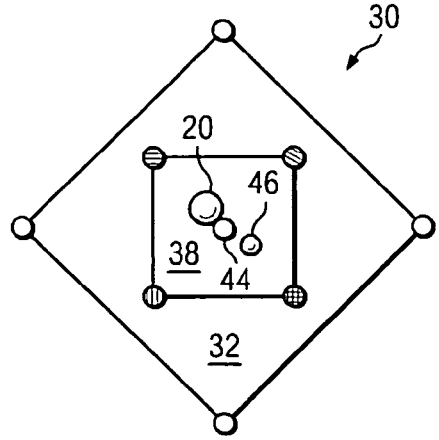
FIG. 9 is another top view of the scoring goal 30 of the present invention illustrating potential positions of the chucker 20 and the OOnagi™ ball 46 during game play.

Referring to FIG. 9, if a player/team knocks the OOnagi™ ball 46 off the OOnagi™ pole 44 and both the OOnagi™ ball 46 and chucker 20 remain in the inner square, this is a "Grand OOnagi" and that player/team wins the game automatically if none of the subsequent players are able to steal the OOnagi™ by knocking the preceding player's chucker 20 out of the inner square 38 or knocking the OOnagi™ ball 46 out of the inner square 38. If a subsequent player is able to knock the OOnagi™ ball 46 out of the inner square 38 and the OOnagi™ ball 46 is struck too hard and lands outside of the outer diamond 32, then the subsequent player's score is rolled back equal to that of the lowest scoring player at the conclusion of the turn.

Points awarded for the OOnagi™ ball 46 may be stolen. For example, if player/team one gets three points for knocking the OOnagi™ ball 46 off the OOnagi™ pole 44 and landing it in the outer diamond 32 while their chucker 20 lands in the outer diamond 32, then player/team three can knock player/team one's chucker 20 out of the outer diamond 32 and steal the three points for the OOnagi™ ball so long as player/team three's chucker 20 remains within the outer diamond 32.

If a player/team's chucker 20 is struck in such a fashion as to drive it into the OOnagi™ pole 44 and knock the OOnagi™ ball 46 off the OOnagi™ pole 44 and it lands in such a manner as to score points, then those points belong to the chucker 20 that actually made contact with the OOnagi™ pole 46. For example, if player two lands the chucker 20 in front of the OOnagi™ pole 44, and player/team four knocks player/team two's chucker 20 into the OOnagi™ pole 44 and knocks off the OOnagi™ ball 46, player/team two is awarded whatever points result from the OOnagi™ since their chucker 20 hit the OOnagi™ pole 44. In the above scenario, if the OOnagi™ ball 46 comes to rest outside of the outer diamond 32, then the player/team that originally pitched the contacting chucker 20 is the player/team whose score is rolled back to the lowest score. In the example above, player two's score would be rolled back to the lowest score.

All of the specifics mentioned in the description of the game shall not be construed as limitations of the scope of this invention, but rather as an exemplification of one preferred embodiment thereof. Other variations are possible. For example, the size of the scoring goal 30, the distance between the chucker board 10 and the scoring goal 30, and the points required to win the game may be varied.

While the invention is shown in only a few of its forms, it is not just limited but is susceptible to various changes and modifications without departing from the spirit thereof. Since modifications and changes may be made to the game to fit particular operating requirements, physical characteristics of the participants, and environments and playing conditions, and those modifications and changes would be apparent to those skilled in the art, the invention is not considered limited to the example chosen for the purpose of disclosure, and covers all modifications and changes, which do not constitute departures from the true spirit and scope of this invention.

We claim:

1. A game comprising:

a substantially flat longitudinal playing surface having two ends, the playing surface suitable for supporting one or more players of the game standing on the playing surface;

a marker, placed at one end of the playing surface;

a scoring goal, placed at the end of the playing surface opposite the marker, the scoring goal having (a) four outer poles inserted into the playing surface forming an outer square having a perimeter and center point, (b) an outer boundary formed by the four outer poles, (c) four inner poles inserted into the playing surface forming an inner square having a center point in common with the outer square and a perimeter smaller than the perimeter of the outer square, (d) an inner boundary formed by the four inner poles;

(e) a game pole inserted into the playing surface at the center point of the outer square and the inner square;

(f) a ball for placing on top of the game pole;

(g) at least two game balls for pitching or rolling at the scoring goal; and (h) a line attached to the four outer poles to form the outer boundary and a line attached to the four inner poles to form an inner boundary.

2. The game of claim 1, wherein each of the inner poles has a color different from the other inner poles.

3. The game of claim 1, wherein the game balls include, (a) a first set of at least two game balls for pitching or rolling at the scoring goal, each ball having a different color; and (b) a second set of at least two game balls for pitching or rolling at the scoring goal, each ball having a marking of a different color corresponding to the different colors of the first set of game balls.

4. The game of claim 3, wherein the first set of game balls includes four balls, each having a different color corresponding to the different colors of the inner poles.

5. The game of claim 4 additionally including a scoreboard.

6. The game of claim 1 wherein the playing surface is suitable for supporting one or more players of the game standing on the playing surface.

7. A game comprising:

a substantially flat longitudinal playing surface having two ends, the playing surface suitable for supporting one or more players of the game standing on the playing surface;

a marker, placed at one end of the playing surface;

a scoring goal, placed at the end of the playing surface opposite the marker, the scoring goal having (a) four outer poles inserted into the playing surface forming an outer square having a perimeter and center point, (b) an outer scoring area formed by the perimeter defined by the four outer poles, (c) four inner poles inserted into the playing surface forming an inner square having a center point in common with the outer square and a perimeter smaller than the perimeter of the outer square, (d) an inner scoring area formed by the perimeter defined by the four inner poles;

(e) a game pole inserted into the playing surface at the center point of the outer square and the inner square;

(f) a ball for placing on top of the game pole;

(g) at least two game balls for pitching or rolling at the scoring goal; and (h) a line attached to the four outer poles to form an outer boundary and a line attached to the four inner poles to form an inner boundary.

8. The game of claim 7, wherein each of the inner poles has a color different from the other inner poles.

9. The game of claim 8, wherein the game balls include, (a) a first set of at least two game balls for pitching or rolling at the scoring goal, each ball having a different color; and (b) a second set of at least two game balls for pitching or rolling at the scoring goal, each ball having a marking of a different color corresponding to the different colors of the first set of game balls.

10. The game of claim 9, wherein the first set of game balls includes four balls, each having a different color corresponding to the different colors of the inner poles.

11. The game of claim 10 additionally including a scoreboard.

* * * * *